US008938831B2

(12) United States Patent
Gilao

(10) Patent No.: US 8,938,831 B2
(45) Date of Patent: Jan. 27, 2015

(54) FRAMED AIR PILLOW FOR UPRIGHT SUPPORT SITTING, AND COMFORT SLEEPING PILLOW SYSTEM

(71) Applicant: Deka A. Gilao, Etobicoke (CA)

(72) Inventor: Deka A. Gilao, Etobicoke (CA)

( * ) Notice: Subject to any disclaimer, the term of this patent is extended or adjusted under 35 U.S.C. 154(b) by 0 days.

(21) Appl. No.: 13/943,462

(22) Filed: Jul. 16, 2013

(65) Prior Publication Data

US 2014/0026324 A1 Jan. 30, 2014

Related U.S. Application Data

(60) Provisional application No. 61/741,309, filed on Jul. 18, 2012.

(51) Int. Cl.
*B68G 5/00* (2006.01)
*A47G 9/10* (2006.01)

(52) U.S. Cl.
CPC ..... *A47G 9/1027* (2013.01); *A47G 9/1072* (2013.01); *A47G 9/1009* (2013.01)
USPC ..... 5/655.3; 5/653; 5/633; 5/615

(58) Field of Classification Search
USPC ..... 5/655.3, 722, 632, 615, 708, 640; 297/284.6, 284.7, 16.1, 284.1
See application file for complete search history.

(56) References Cited

U.S. PATENT DOCUMENTS

| | | | | |
|---|---|---|---|---|
| 4,810,034 | A * | 3/1989 | Beier | 297/284.7 |
| 5,190,348 | A * | 3/1993 | Colasanti | 297/284.6 |
| 5,345,630 | A * | 9/1994 | Healy | 5/708 |
| 5,425,567 | A * | 6/1995 | Albecker, III | 297/377 |
| 5,806,115 | A * | 9/1998 | Brown | 5/615 |
| 5,970,545 | A * | 10/1999 | Garman et al. | 5/615 |
| 6,139,567 | A * | 10/2000 | McCarty et al. | 606/237 |
| 6,739,005 | B2 * | 5/2004 | Davis | 5/615 |
| 7,134,158 | B2 * | 11/2006 | Tokarz | 5/632 |
| 7,231,681 | B2 * | 6/2007 | Kasatshko et al. | 5/722 |
| D551,484 | S * | 9/2007 | Kasatshko et al. | D6/604 |
| 7,360,266 | B2 * | 4/2008 | Kasatshko | 5/722 |

* cited by examiner

*Primary Examiner* — Peter M Cuomo
*Assistant Examiner* — Brittany Wilson
(74) *Attorney, Agent, or Firm* — Nasser Ashgriz; UIPatents Inc.

(57) ABSTRACT

The present invention is related to a framed air pillow system, using air pressure to provide stability and comfort for a user when sitting in an upright position. The invention comprises of a base frame structure, an inflatable air chamber having an air pump and a rectangular cushion pad, wherein said system having means to adjust the angle between said base and said rectangular cushion pad.

1 Claim, 9 Drawing Sheets

FRAMED AIR PILLOW FOR UPRIGHT SUPPORT SITTING, AND COMFORT SLEEPING PILLOW SYSTEM

CROSS REFERENCES

This non provisional application relates to its own the provisional application # U.S. 61/741,309 filed on Jul. 18, 2012. Other prior arts that may relates are, U.S. Pat. No. 5,425,567, U.S. Pat. No. 7,134,158 B2, and U.S. Pat. No. 5,970,545A.

BACKGROUND OF THE INVENTION

This is a framed inflatable air pillow that helps maintaining an adjustable upright position for the upper body. It comprises three main units; the pillow or cushion that is air inflatable, the air chamber that is mostly inside the said pillow and partially extends outside the pillow to the posterior side of the system and the back base that forms a hinge joint with the said pillow. The air volume in the air chamber controls the angle between the base and the pillow making the system easily adjustable by the user.

This product is invented to overcome many common problems associate with back pain that in many cases starts with back muscle strain due to acquired bad posture while sitting. The frame work design system of this product and the air pressure against the body weight encourages to relax the muscles by supporting a straight posture sitting position and a good spinal alignment.

Prior art U.S. Pat. No. 5,425,567 emphasize the convenience of back support leisure for portability and back support with extra attachments to the lower lumbar and neck for spinal alignment. Others prior art U.S. Pat. No. 7,134,158 B2, and U.S. Pat. No. 5,970,545A talked about how inflated members can help to lift patients from laid down position to inclined position using inflating/deflating of air pumps.

This present invention solves the inconvenience of many prior arts in the field of back support. Its unique design combines structural framework and air pressure. The art of this invention emphasizes the quality of comfort due to the integration of the outer layer surfaces such as memory foam and the durable plastic in the back. This framed air pillow converts into a comfortable sleep pillow due to its adjustability to recline within its own framework.

The following invented product may be considered as a medical device as it supports people with many different medical disorders (such as: sleep apnea, acid reflex, stomach bleeding, emphysema, muscular disorder, injuries, legs edema, back problems and many more). This product is also ideal for anybody including for many young people who prefers sitting on bed while doing whether school work, using laptop, writing, reading, watching television, etc. This product can be inflated or deflated effortlessly. When deflated completely shrinks to a small, light weight, portable and easy to travail with.

This invention does not exclude any other possible improvement, for example by placing more than one air chamber for more flexibility in deflating the extended back triangular section to allow the embodiment to be usable on a regular chair as an extra back support. This product can be further improved also by adding heating pads or/and massage pads. Furthermore it can also be developed to be incorporated or built into furniture such as: couches, sofas, car seats and bed head boards and more.

BRIEF SUMMARY OF THE INVENTION

This is a framed inflatable air pillow that helps maintaining an adjustable upright position for the upper body. It comprises three main units; the pillow or cushion that is air inflatable, the air chamber that is mostly inside the said pillow and partially extends outside the pillow to the posterior side of the system and the back base that forms a hinge joint with the said pillow. The air volume in the air chamber controls the angle between the base and the pillow making the system easily adjustable by the user.

This product is invented to overcome many common problems associate with back pain that in many cases starts with back muscle strain due to acquired bad posture while sitting. The frame work design system of this product and the air pressure against the body weight encourages to relax the muscles by supporting a straight posture sitting position and a good spinal alignment.

This proposed invention comprises a rectangular pillow, cushion or the like, supports the back and the shoulders, attached from the posterior to an extended horizontal base that functions to provide stability for the system. The said cushion is air inflatable and there does exists at least one air chamber built in the cushion. The angle between the said base and the said cushion is adjustable and may change by changing the air pressure inside the said air chamber. The air pressure is adjusted by the user to provide comfort and support.

BRIEF DESCRIPTION OF THE DRAWINGS

The proposed invention is related to an air pillow-back support device. It is composed of three main parts; the cushion, the air chamber and the stabilizing base. The angle between the cushion and the base may be varied accordingly with varying the air pressure in the air chamber. When the air chamber is fully inflated, the cushion stands in a fully vertical position.

DETAIL DESCRIPTION OF THE INVENTION

The profile of the said pillow is designed with curvatures that accommodates for the natural curves of the vertebral column; the cervical and the thoracolumbar. The outer layer of the said pillow is said to be memory foam which will shape around the body and decrease the pressure on the muscles and the joints.

The said air chamber is uniquely designed to provide stability and rigidity to the embodiment. It has three distinguished sections; the upper back section is structured by two tube-like parts that is responsible to provide stability for the shoulders, the lower back section is structured by a relatively big rectangular room that is curved to suit the lumber region, and the back push section that extends outside the pillow and has a triangular profile effective to carry the body weight. The air chamber is made from inflatable, flexible and strong plastic material.

The main function of the back base is to give the embodiment a firm ground support. The base has two articulating hands that are attached to the pillow from the posterior side and form a hinge joint with the main base board. This construction allows the pillow rotate around the base thus recline and incline according to the user preference. Each of the articulating hands is locked with a locking pin that prevents the hand from reclining. The locking system and the air chamber work together to sustain the weight of the user. The locking pins are released by a handle that may be placed on the side of the pillow close to the reach of the user. The locking pins prevent rotation on one direction only which is reclining the pillow or leaning backward. When air is pumped into the air chamber, the locking pins are pushed open allowing the hands and thus the pillow to rise.

Releasing air from the air chamber, with the weight of the body acting on the system and the locking pins are released, causes the triangular section of the air chamber to compress and fold.

The frames, base and the locking mechanism are said to be made of strong plastic materials that are hard to break and are able to sustain heavy weight loads.

DETAIL DESCRIPTION OF THE DRAWINGS

Figure 1:
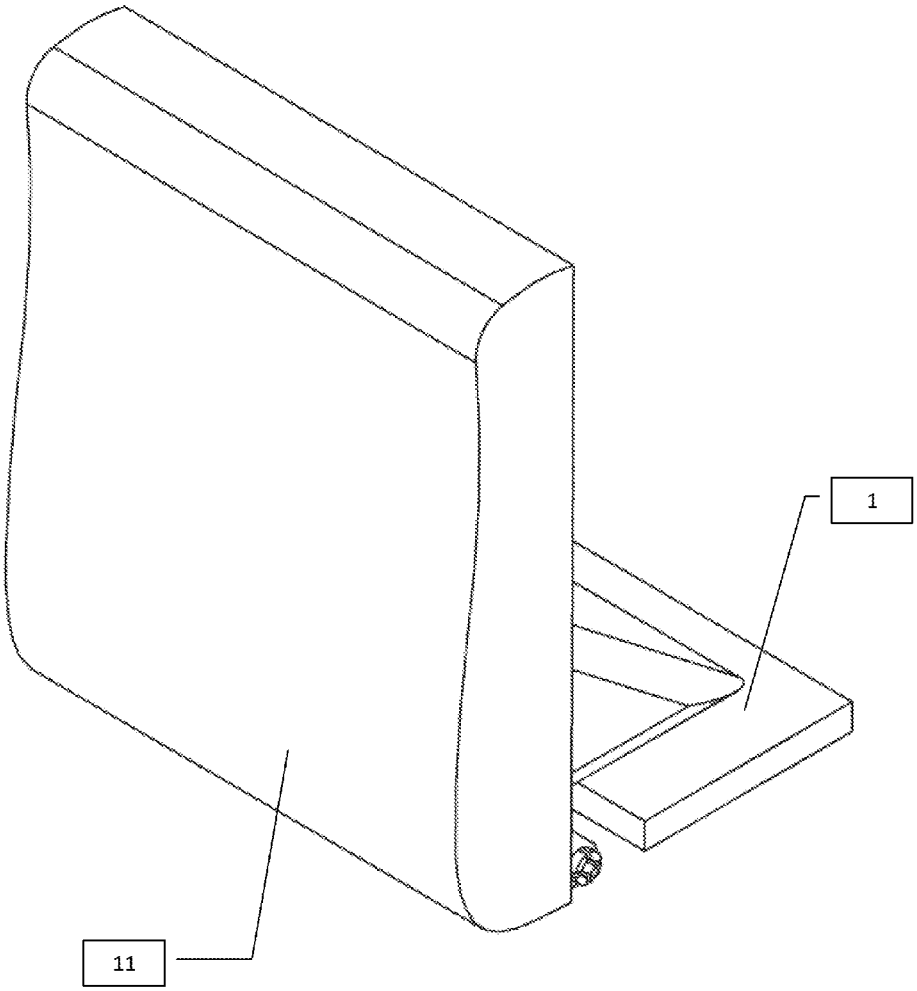
FIG. 1: Isometric view of the whole system.

FIG. 1: Isometric view of the whole system showing the base '1', and the cushion '11'.

Figure 2:
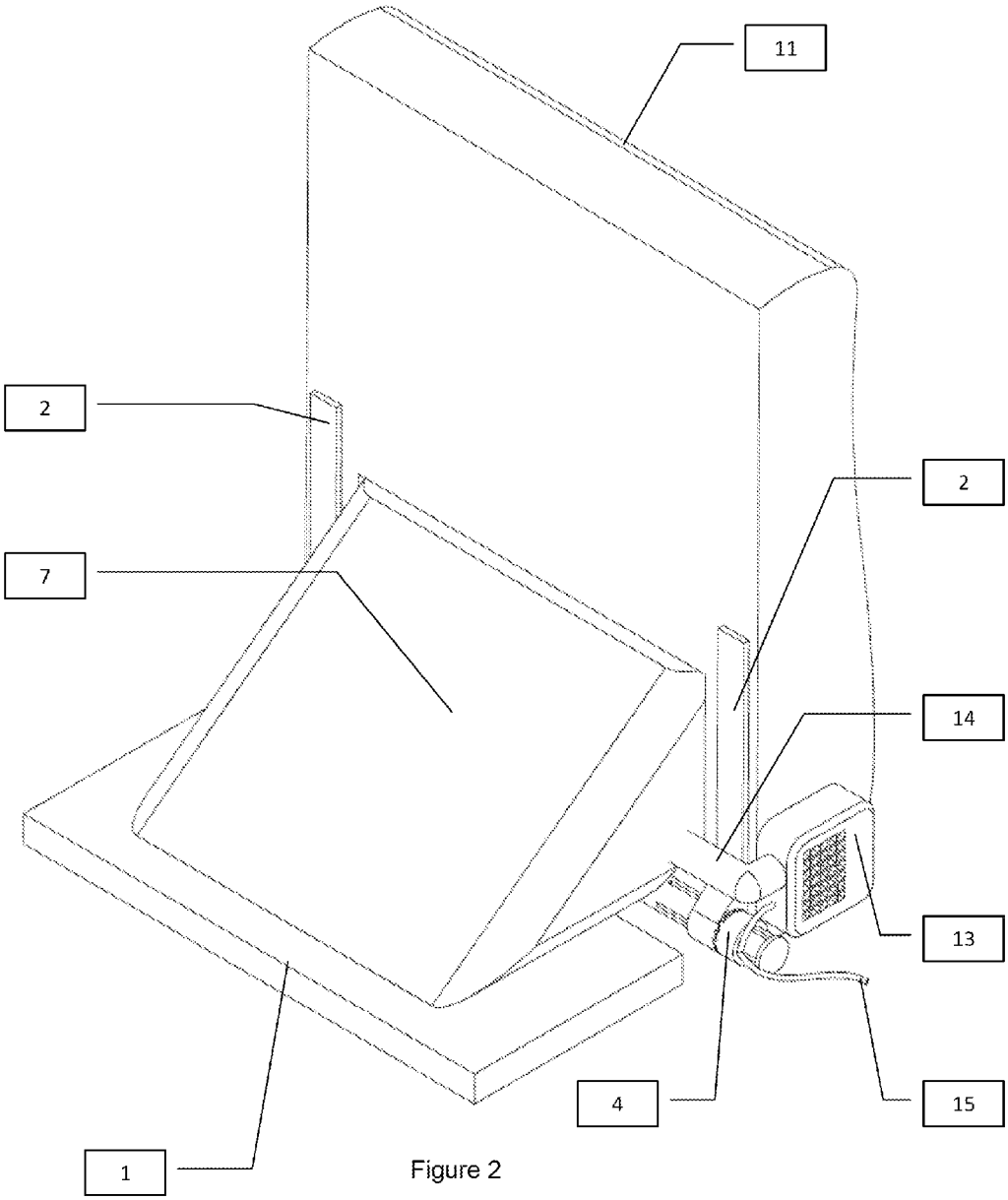
FIG. 2: Isometric view showing the system from a posterior angle.

FIG. 2: Isometric view showing the system from a posterior angle. Appearing is the base '1' that articulate with the two standing frame hands '2'. The cushion '11' that is tightly connected with the frame hands. Showing the posterior section of the air chamber '7', the locking pin '4' that is responsible to provide more stability. The air pump '13' is shown and connected in one possible way and is not restricted to this shown position. Connected to the air pump is the air inlet hose '14' and the electrical wire '15'.

Figure 3:
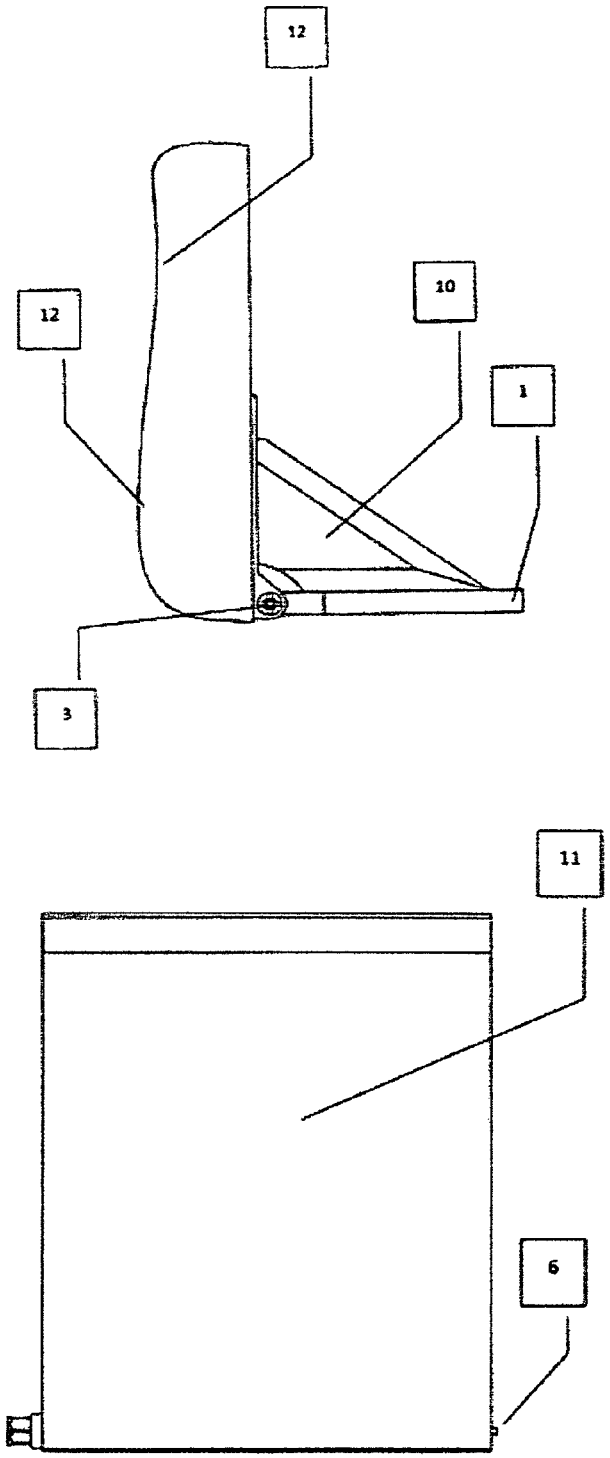
FIG. 3: Two dimensional views of the system one from the front and one from the side.

FIG. 3: Two dimensional views of the system one from the front and one from the side. Showing in the figure the cushion front face '11' where the memory foam is placed. The side view shows the proposed cushion profile '12' emphasizing the cervical and the thoracolumbar curves. Also showing the posterior section of the air chamber that has a triangular shape '10' and responsible for the pushing force against the body weight. Showing also the axis '3' where the base '1' and the standing frame hands join and articulate. The place of a handle to release the locking pins when the cushion angle need to be changed is proposed by '6'.

Figure 4:
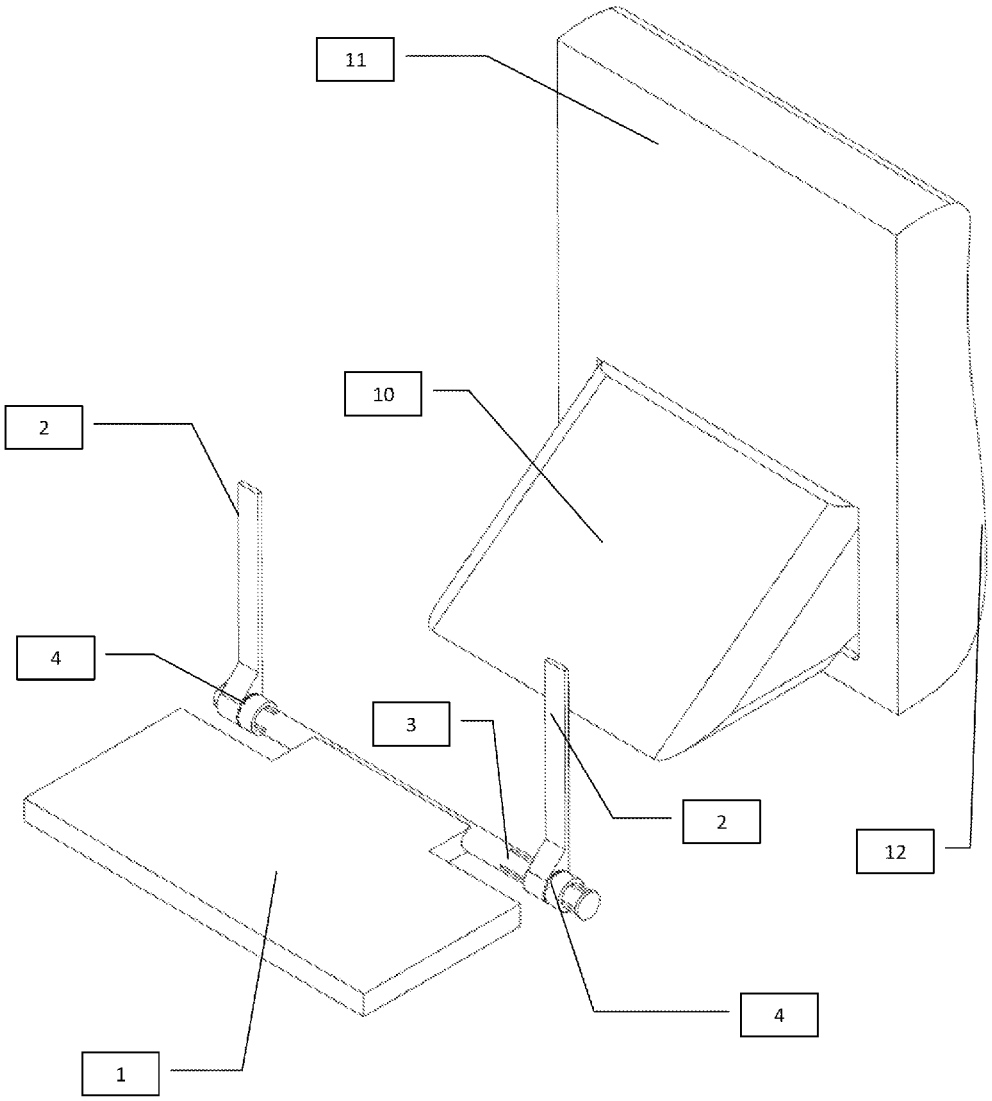
FIG. 4: A three dimensional of the system shown from the posterior side.

FIG. 4: A three dimensional of the system shown from the posterior side. Showing the frames '2' and the base '1' complex separated from the cushion '11' and the air chamber complex. The axis '3' is where the two standing frames '2' pivot around. The locking pins '4' lock the standing frames in the desired angle along with the pushing force of the triangular back section '10' of the air chamber.

Figure 5:
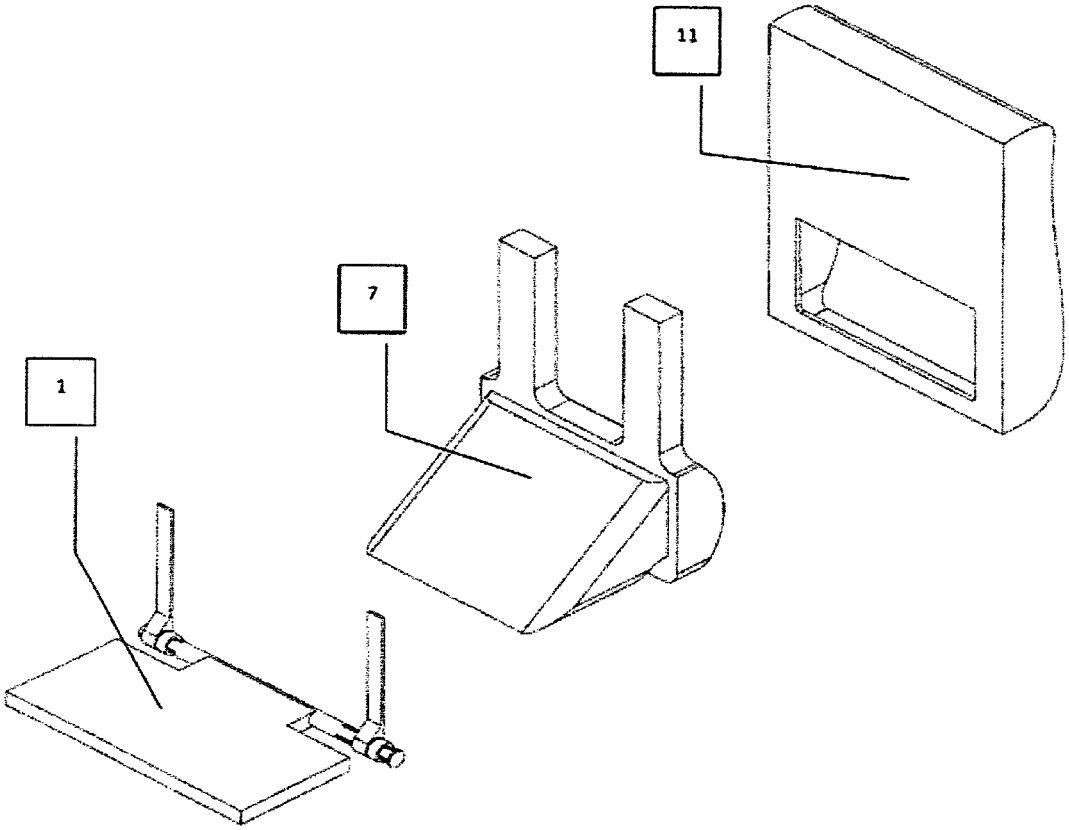
FIG. 5: Illustrational view of the three main parts that compose the system.

FIG. 5: This figure is a good illustration to view the three main parts that compose the system: the base '1', the air chamber '7' and the cushion '11'.

Figure 6:
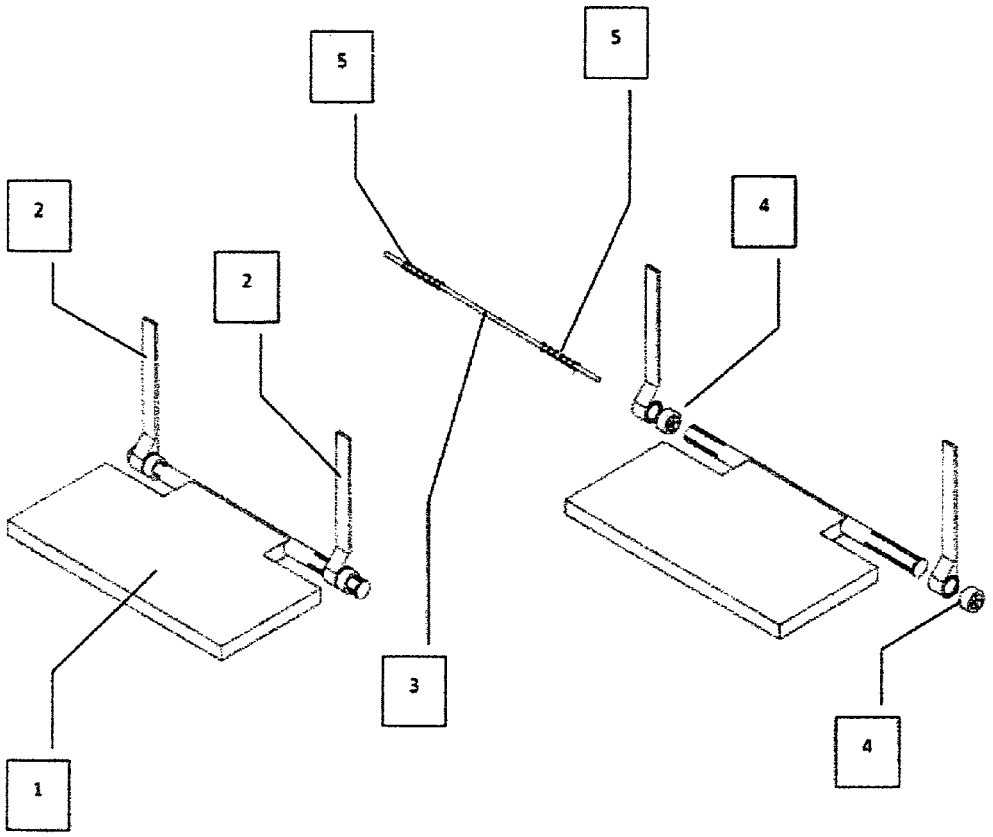
FIG. 6: Shows how the base complex is constructed.

FIG. 6: Shows haw the base complex is constructed. The two standing frames '2' pivot around the axis of the base '1' and are locked by the locking pins '4' when desired. The shaft '3' is placed in the center of the base axis and holds two springs '5' which are responsible to keep the locking pins '4' in the locking position.

Figure 7:
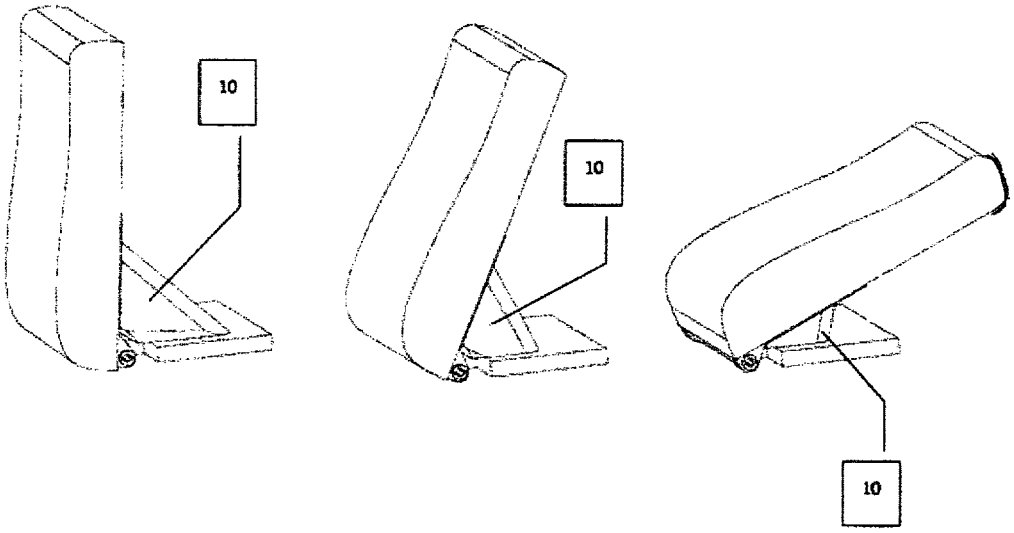
FIG. 7: Shows the proposed system in different angles.

FIG. 7: Shows the proposed system in different angles where the triangular section '10' of the air chamber compressed when the angle of the cushion is decreased and the air is released in order to recline the system.

Figure 8:
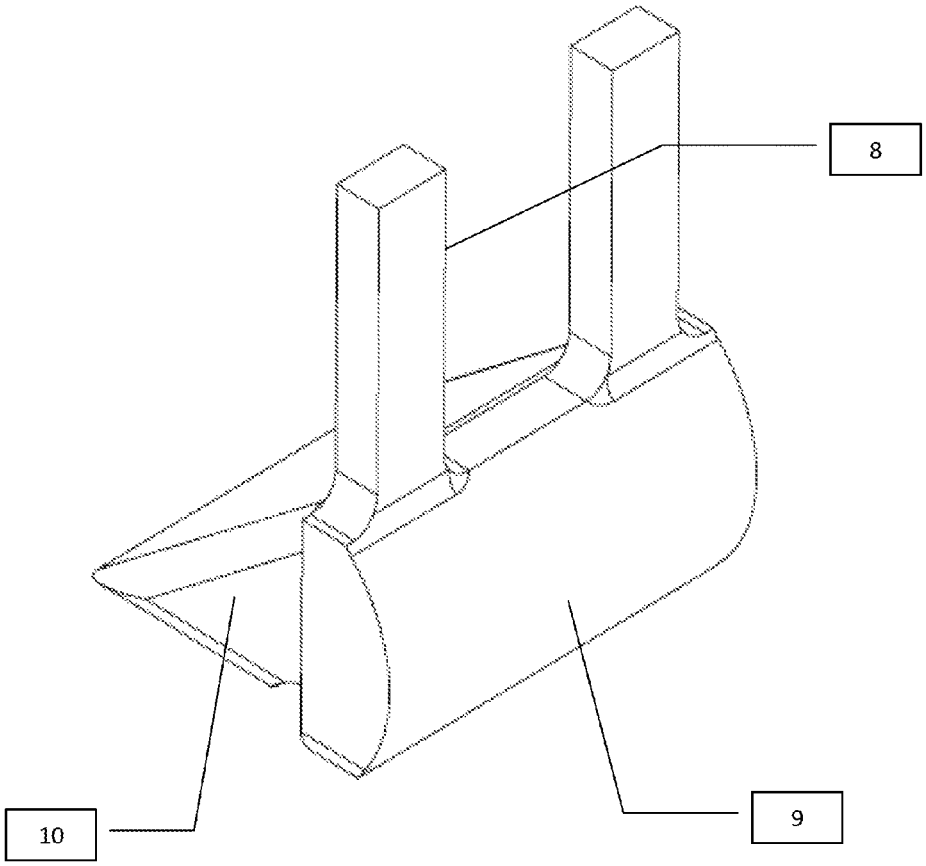
FIG. 8: Isometric view of the air chamber.

FIG. 8: Isometric view of the air chamber alone with three sections outlined; upper section '8', lower section '9' and the triangular rear section '10'.

Figure 9:
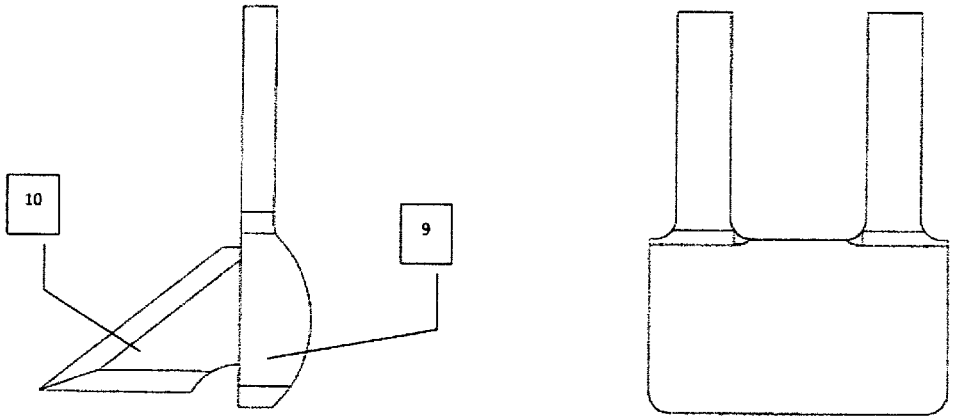
FIG. 9: Two dimensional view of the air chamber.

FIG. 9: Two dimensional view of the air chamber alone outlining the curvature of the lower section '9' that helps supporting the lower back and the lumber region.

The invention claimed is:

1. A portable and adjustable angle back support cushion to provide a desired sitting posture and a good spinal alignment for an upper body of a user comprising:

a. a substantially rectangular cushion having a front side and a back side, said back side having an opening shaped to receive an inflatable support element;

b. a stand comprising a base having an area to engage with the ground; a set of movable arms, each having a proximal end and a front face; said each proximal end being pivotally connected to said base; said each front face being attached to the back side of said cushion; and a mechanical lock to lock said movable arms at a desired inclined angle; and c. said inflatable support element comprising a wedge shaped section having a bottom surface to engage with said base, an inclined top surface, and a front surface, the intersection of the top and the front surfaces forming the top wedge edge; and at least two inflatable support tubes extending upward from the top wedge edge;

d. an air pump to inflate said inflatable support element;

whereby said inflatable element and said stand support said cushion in an inclined position and whereby the front surface and the two support tubes being inserted into the opening at the back side of the cushion to support the cushion when inflated, and whereby said two support tubes support the thoracic spine of said user, and whereby the stiffness of the front side of the cushion being controlled by the pressure inside the wedge shaped element.

* * * * *